US008390529B1

(12) United States Patent
Paulsen et al.

(10) Patent No.: US 8,390,529 B1
(45) Date of Patent: Mar. 5, 2013

(54) PCB SPIRAL ANTENNA AND FEED NETWORK FOR ELINT APPLICATIONS

(75) Inventors: Lee M. Paulsen, Cedar Rapids, IA (US); Richard A. Freeman, Cedar Rapids, IA (US); James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 406 days.

(21) Appl. No.: 12/822,339

(22) Filed: Jun. 24, 2010

(51) Int. Cl.
*H01Q 1/38* (2006.01)
*H01Q 1/50* (2006.01)

(52) U.S. Cl. ..... 343/895; 343/700 MS

(58) Field of Classification Search ..... 343/767, 343/770, 895, 700 MS
See application file for complete search history.

(56) References Cited

U.S. PATENT DOCUMENTS 5,313,216 A 5/1994 Wang et al.
5,815,122 A * 9/1998 Nurnberger et al. ..... 343/767
6,137,453 A 10/2000 Wang et al.
2004/0196190 A1* 10/2004 Mendolia et al. ..... 343/700 MS
2006/0092079 A1* 5/2006 de Rochemont ..... 343/700 MS
2008/0030422 A1* 2/2008 Gevargiz et al. ..... 343/860
2010/0026590 A1* 2/2010 Chiang et al. ..... 343/702
2010/0289719 A1* 11/2010 Wang et al. ..... 343/895
2011/0177839 A1* 7/2011 Baliarda et al. ..... 455/550.1
2012/0146853 A1* 6/2012 Chang et al. ..... 343/700 MS
2012/0162015 A1* 6/2012 Chen et al. ..... 343/700 MS

* cited by examiner

*Primary Examiner* — Don Le

(74) *Attorney, Agent, or Firm* — Donna P. Suchy; Daniel M. Barbieri

(57) ABSTRACT

The present invention is directed to an integrated antenna and feed network assembly. The integrated antenna and feed network assembly includes a spiral antenna which is suitable for implementation with ELINT DF systems. The integrated antenna and feed network assembly further includes a feed network, which may include a stripline Balun feed. The feed network is electrically connected to the antenna. Further, the integrated antenna and the feed network assembly provides for integration of the antenna and the feed network into a single PCB assembly.

18 Claims, 3 Drawing Sheets

PCB SPIRAL ANTENNA AND FEED NETWORK FOR ELINT APPLICATIONS

FIELD OF THE INVENTION

The present invention relates to the field of antenna technology and particularly to a PCB spiral antenna and feed network for ELINT applications.

BACKGROUND OF THE INVENTION

Currently available Electronic Intelligence (ELINT) Direction Finding (DF) systems have relied upon 2-18 Gigahertz (GHz), cavity-backed spiral antennas. These cavity-backed spiral antennas are bulky, expensive and not amenable to conformal mounting. For example, currently available Commercial-Off-The-Shelf (COTS) cavity-backed spiral antennas may be about 2 inches deep, and may include a layer of absorber material to absorb the back-wave radiating off the spiral. Although these currently available COTS cavity-backed spiral antennas may have excellent 2-18 GHz Voltage Standing Wave Ratio (VSWR) and gain patterns, they may suffer from the effects of hand assembly, which drives up the price for the phase-matched sets required for ELINT DF systems. Further, these currently available COTS cavity-backed spiral antennas may not meet desired specifications for ELINT DF systems.

Thus, it would be desirable to provide a spiral antenna suitable for implementation with ELINT DF systems which obviates the problems associated with currently available spiral antenna implementations.

SUMMARY OF THE INVENTION

Accordingly, an embodiment of the present invention is directed to an integrated antenna and feed network assembly, including: an antenna; and a feed network, the feed network being electrically connected to the antenna, wherein the integrated antenna and feed network assembly is a printed circuit board assembly.

A further embodiment of the present invention is directed to an integrated antenna and feed network assembly, including: an antenna, the antenna including an RF substrate, the antenna further including an antenna element, the antenna element being a metal foil layer configured upon a first surface of the RF substrate, the antenna further including an antenna ground plane, the antenna ground plane being configured upon a second surface of the RF substrate, the second surface being located generally opposite the first surface; and a feed network, the feed network being electrically connected to the antenna, the feed network including a first RF substrate, the feed network further including a second RF substrate, the feed network further including a feed, the feed being connected to the first RF substrate and the second RF substrate, the feed being configured between the first RF substrate and a first surface of the second RF substrate, the feed network further including a feed ground plane, the feed ground plane being configured upon a second surface of the second RF substrate, the second surface of the second RF substrate being located generally opposite the first surface of the second RF substrate, wherein the antenna and the feed network assembly is a printed circuit board assembly.

A still further embodiment of the present invention is directed to an integrated antenna and feed network assembly, including: a spiral antenna, the antenna including a PCB substrate, the antenna further including an antenna element, the antenna element being a copper foil layer patterned upon a first surface of the PCB substrate, the antenna further including an antenna ground plane, the antenna ground plane being configured upon a second surface of the PCB substrate, the second surface being located generally opposite the first surface; a feed network, the feed network being electrically connected to the antenna, the feed network including a first PCB substrate, the feed network further including a second PCB substrate, the feed network further including a feed, the feed being connected to the first PCB substrate and the second PCB substrate, the feed being configured between the first PCB substrate and a first surface of the second PCB substrate, the feed network further including a feed ground plane, the feed ground plane being configured upon a second surface of the second PCB substrate, the second surface of the second PCB substrate being located generally opposite the first surface of the second PCB substrate, the integrated antenna and feed network assembly further including a plurality of vias formed therein, said vias longitudinally extending from the antenna element, through the PCB substrate of the antenna, through the antenna ground plane, through the first PCB substrate of the feed network, and to the feed for electrically connecting the antenna and the feed network; an RF connector, the RF connector being configured for connecting the integrated antenna and feed network assembly to a receiver via a coax cable; and a radome, the radome being connected to the antenna element, wherein the integrated antenna and the feed network assembly is a printed circuit board assembly.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
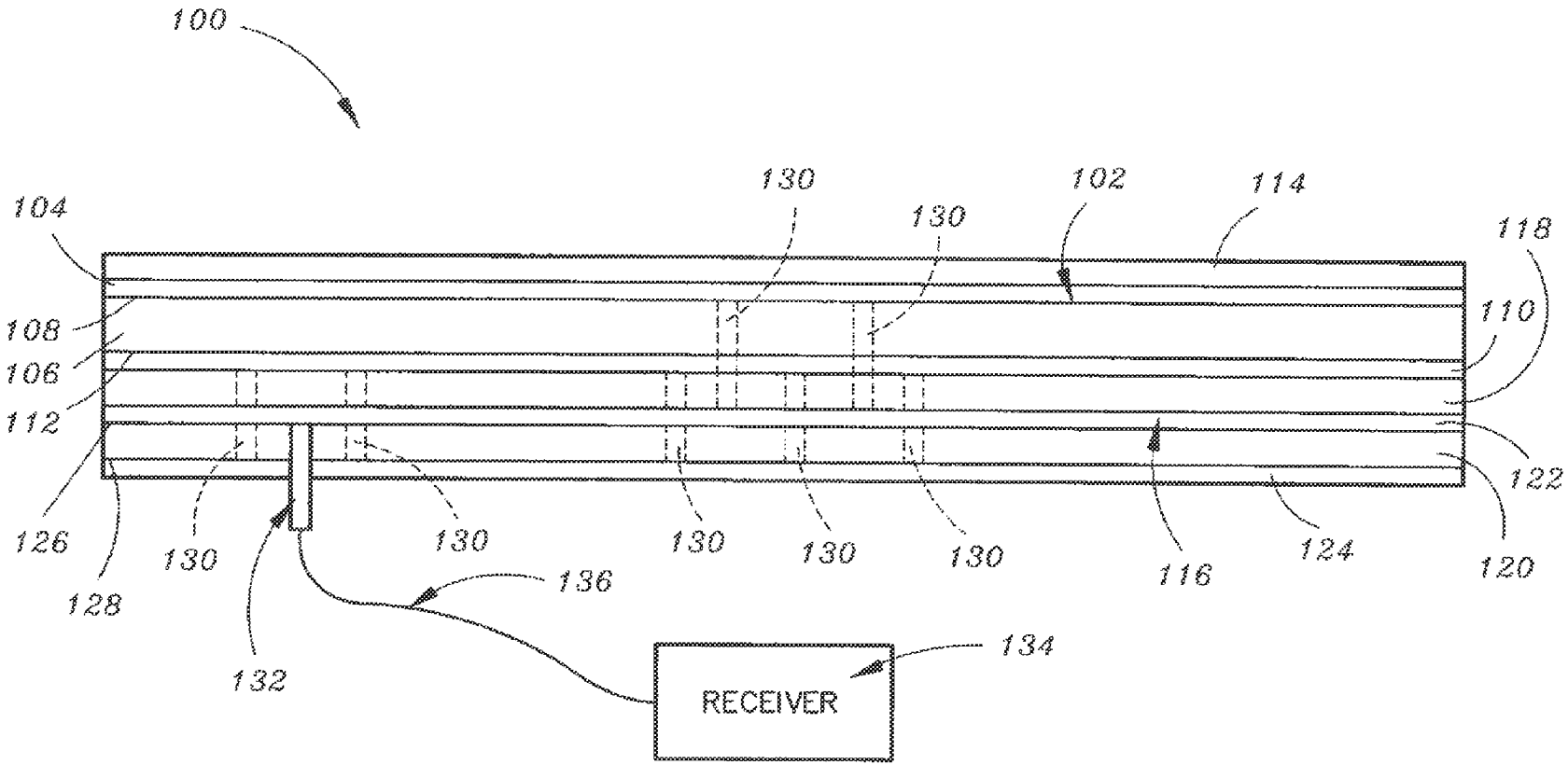
FIG. 1 is a cross-sectional view of an integrated antenna and feed network assembly in accordance with an exemplary embodiment of the present invention.

Referring to FIG. 1, an integrated antenna and feed network assembly 100 in accordance with an exemplary embodiment of the present invention is shown. In an exemplary embodiment of the present invention, the assembly 100 includes an antenna 102. In further embodiments of the present invention, the antenna 102 may be a spiral antenna, a microstrip antenna and/or a multioctave microstrip antenna, such as one or more of the antenna embodiments disclosed in U.S. Pat. Nos. 5,313,216 and 6,137,453, which are herein incorporated by reference.

Figure 3:
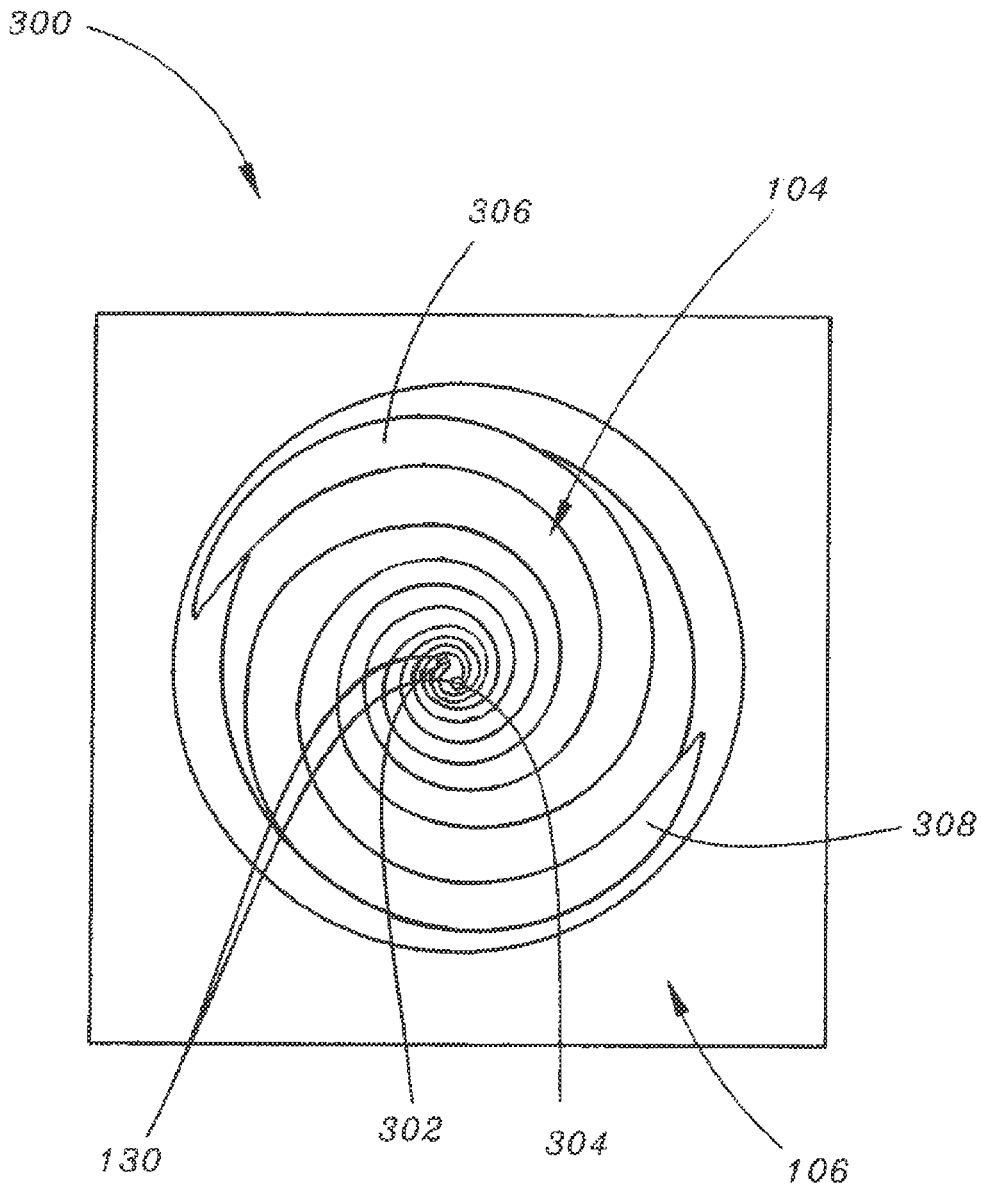
FIG. 3 is a top plan view of an integrated antenna and feed network assembly (without a radome) in accordance with a further exemplary embodiment of the present invention.

In a current exemplary embodiment of the present invention, the spiral antenna 102 may include an antenna element 104 and a Radio Frequency (RF) substrate 106, the antenna element 104 being connected to the RF substrate 106. For instance, the antenna element 104 may be a metal layer, a metallization layer, and/or a metal foil layer (ex.—copper foil layer) which has been formed upon (ex.—patterned upon) a first surface 108 (ex.—a top surface 108) of the RF substrate 106. In further embodiments of the present invention, such as the integrated antenna and feed assembly 300 shown in FIG. 3, the antenna element 104 may form a tightly-wound spiral pattern (ex.—may be a spiral antenna element 104, a printed spiral antenna element 104, and/or a PCB spiral antenna element 104) and may be configured for providing (exs.—emitting or radiating) a radiation pattern (ex.—a receive-mode radiation pattern and/or a transmit-mode radiation pattern). In still further embodiments of the present invention, the RF substrate 106 may be formed of Printed Circuit Board (PCB) material (ex.—may be a PCB substrate 106).

In an exemplary embodiment of the present invention, the spiral antenna 102 may further include a ground plane 110 (ex.—an antenna ground plane 110). The ground plane 110 may be connected to a second surface 112 (ex.—a bottom surface 112) of the RF substrate 106, the second surface 112 being oriented generally opposite the first surface 108. In further embodiments of the present invention, the ground plane 110 may be a metal layer, a metallization layer, and/or a metal foil layer (ex.—a 95% copper foil layer) which has been formed upon (ex.—patterned upon) the bottom surface 112 of the RF substrate 106. In still further embodiments, the spiral antenna 102 may further include a radome 114. The radome 114 may be connected to (ex.—may at least substantially enclose or cover) the antenna element. For example, the radome 114 may be constructed of Printed Circuit Board (PCB) material.

In a current exemplary embodiment of the present invention, the assembly 100 may further include a feed network 116. In an exemplary embodiment of the present invention, the feed network 116 may include a first RF substrate 118, a second RF substrate 120 (ex.—PCB substrates 118, 120) and a feed 122. The first PCB substrate 118 of the feed network 116 may be connected to the ground plane 110 of the spiral antenna 102. In further embodiments, the feed 122 may be connected or embedded between the first PCB substrate 118 and the second PCB substrate 120 of the feed network 116. The second PCB substrate 120 may include a first surface 126 (ex.—a top surface 126) and a second surface 128 (ex.—a bottom surface 128), the second surface 128 being oriented generally opposite the first surface 126. In still further embodiments of the present invention, the feed network 116 may further include a ground plane 124 (ex.—a feed ground plane 124). In further embodiments of the present invention, the ground plane 124 may be a metal layer, a metallization layer, and/or a metal foil layer (ex.—a 95% copper foil layer) which has been formed upon (ex.—patterned upon) the bottom surface 128 of the second PCB substrate 120.

In an exemplary embodiment of the present invention, the feed 122 of the feed network 116 may be a Balun feed (ex.—a stripline Balun feed 122). Further, the stripline Balun feed 122 may be configured for functioning as a 2-18 Gigahertz (GHz) Balun, thereby allowing the feed network 116 to be a 2-18 GHz Balun feed network 116. Still further, the stripline feed 122 may be a shielded stripline feed 122, thereby allowing the feed network 116 to provide a shielded stripline configuration or topology. Alternative embodiments of the present invention may implement microstrip or co-planar waveguide topologies for the feed network 116. Although the microstrip or co-planar waveguide topologies may be more prone to parasitic radiation effects than the shielded stripline topology, the microstrip or co-planar waveguide topologies may provide a suitable low cost feed network configuration over a lower range of frequencies (ex.—500 Megahertz (MHz) to 6 GHz). In further embodiments of the present invention, the feed 122 may include (ex.—may implement) one or more of the following components: Lange couplers; a tapered line Balun; a Marchand stripline balun; cascaded ninety degree hybrids; Wilkinson splitters with Shiffman phase shifters; cascaded one-hundred-eighty degree couplers; tapered coupled lines; and/or Marchand-type baluns.

In at least one current exemplary embodiment of the present invention, as shown in FIG. 1, the radome 114, the antenna element 104, RF substrate 106, ground plane 110, RF substrate 118, the feed 122, and ground plane 124 may be integrated in a stacked configuration (exs.—as part of and/or as layers of a PCB laminate stack, a monolithic PCB package, a single PCB build and/or a single PCB assembly), thereby providing the integrated antenna and feed network assembly 100 of the present invention. In further embodiments of the present invention, the integrated antenna and feed network assembly 100 may have a plurality of channels or vias 130 (ex.—micro-coax via interconnects 130) formed therein for electrically connecting the antenna 102 and the feed network 116. For example, one or more of the vias 130 may extend longitudinally from the antenna element 104, through the RF substrate 106, through the ground plane 110, through RF substrate 118, and to the feed 122 for electrically connecting the antenna element 104 to the feed 122. For instance, as shown in the assembly 300 in FIG. 3, the vias 130 may electrically connect to the antenna element 104 (ex.—spiral antenna element 104) at terminals (302, 304) of the spiral arms (306, 308) of the spiral antenna element 104. Further, one or more of the vias 130 may extend longitudinally from the ground plane 110, through RF substrate 118, through the feed 122, through RF substrate 120 and to the ground plane 124 for electrically connecting the ground plane 110 of the antenna 102 to the ground plane 124 of the feed network 116. In still further embodiments of the present invention, the vias 130 may be formed as plated and drilled through holes or through channels.

In exemplary embodiments of the present invention, the integrated antenna and feed network assembly 100 may further include an RF connector 132 (ex.—a surface mount RF connector) which is configured for being connected to (ex.—mounted upon) the assembly 100. In further embodiments of the present invention, the surface mount RF connector 132 is further configured for being connected to the feed network 116 (ex.—the feed 122). In still further embodiments of the present invention, the integrated antenna and feed network assembly 100 may further include a RF transceiver 134 (ex.—RF receiver). In further embodiments, the RF receiver 134 may be electrically connected to the RF surface mount connector 132 via a coaxial cable 136.

In current exemplary embodiments of the present invention, the antenna 102 of the integrated antenna and feed network assembly 100 may include Commercial-Off-The-Shelf (COTS) components (ex.—may be a COTS antenna 102). In further embodiments of the present invention, the antenna 102 may be a uni-directional antenna 102. In further embodiments of the present invention, both the antenna 102 and the feed network 116 may be planar.

Thus, in current exemplary embodiments of the present invention, such as described above, the integrated antenna and feed network assembly 100 provides a spiral antenna 102 which is PCB-compliant or PCB-based (ex.—is integrated with or embedded in a PCB substrate 106). The above-described embodiments of the integrated antenna and feed network assembly 100 further provides a feed network 116 which is PCB-compliant or conformal. For instance, the feed 122 may be integrated with or embedded between PCB substrates 118, 120, as shown in FIG. 1. By integrating the antenna 102 and feed network 116 into a single assembly (exs.—PCB assembly, PCB laminate stack, monolithic PCB package, single PCB build), the integrated antenna and feed network assembly of the present invention provides a low-cost, low-profile and light weight alternative to currently available antenna assemblies. For example, because the integrated assembly 100 of the present invention may be produced by an assembly process which may be easily repeatable, the integrated assembly may provide a lower cost alternative to currently available antenna assemblies. Further, as mentioned above, because the assembly 100 of the present invention integrates the antenna 102 and feed network 116 into a single PCB build or structure (ex.—having a thickness of less than 0.3 inches), the assembly 100 of the present invention may provide a lower profile alternative to currently available antenna assemblies.

In exemplary embodiments of the present invention, the integrated antenna and feed network 100 may be suitable for Electronics Intelligence (ELINT) applications (ex.—may be implemented as part of an ELINT Direction Finding (DF) system) may be compliant with desired ELINT DF specifications. Further, the integrated antenna and feed network 100 of the present invention may be utilized in ELINT DF systems which implement Unmanned Aerial Vehicles (UAVs). For example, the integrated antenna and feed network 100 of the present invention may be installed via a conformal, wing-tip installation scheme onto aircraft implemented in ELINT DF systems (ex.—installed on business jet class platforms).

Figure 2:
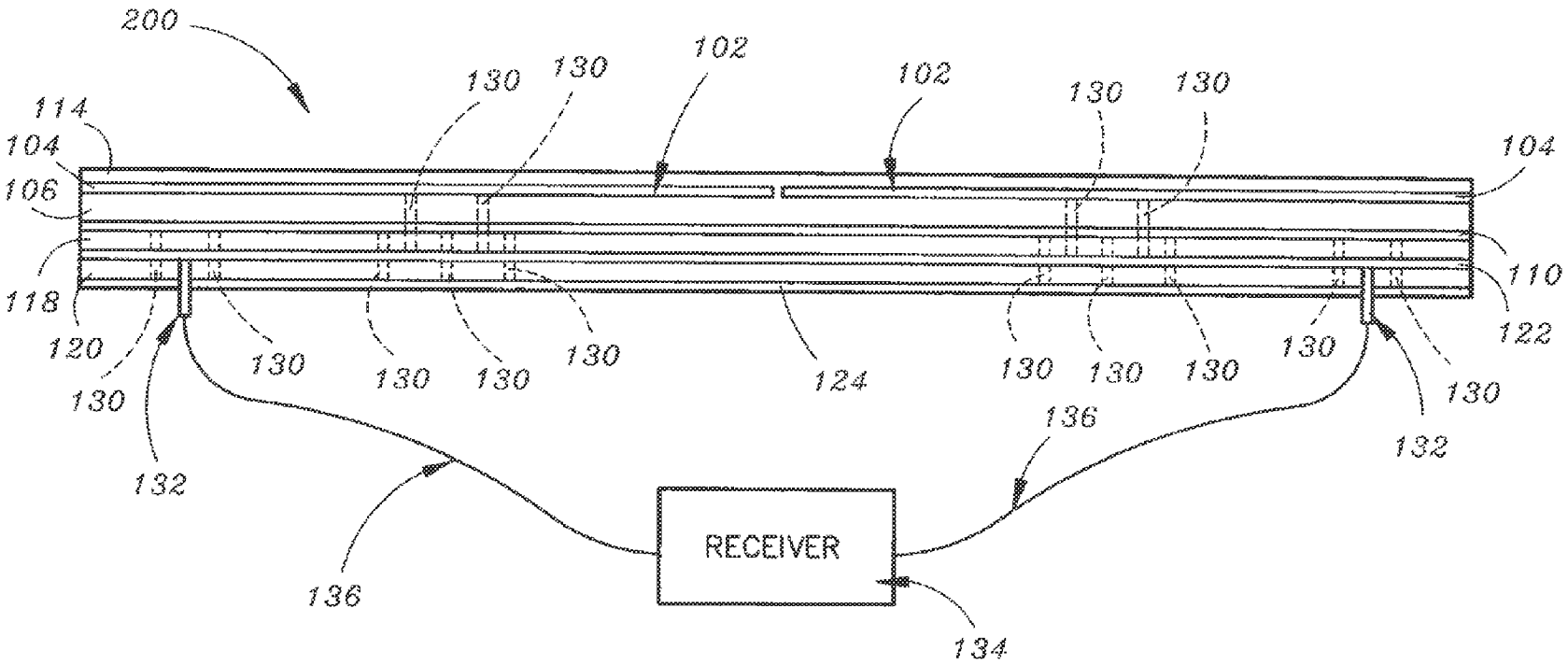
FIG. 2 is a cross-sectional view of an integrated antenna and feed network assembly having multiple antenna elements (ex.—an antenna array) in accordance with a further exemplary embodiment of the present invention.

Referring to FIG. 2, an integrated antenna and feed network assembly 200 in accordance with an alternative embodiment of the present invention is shown. The integrated assembly 200, such as shown in FIG. 2, may be constructed, may function and may be implement as the integrated assembly 100 shown in FIG. 1, except that integrated assembly 200 includes multiple antennas 102 (ex.—multiple antenna elements 104), with said multiple elements 104 forming an antenna array. The multiple antenna elements 104 may be separate metal foil layer sections intermittently patterned upon (ex.—spaced along) the top surface 108 of the RF substrate 106. Further, integrated assembly 200 may include multiple surface RF connectors 132 (ex.—one RF connector 132 for each antenna element, each RF connector being connected to the receiver 134 via a corresponding coax cable 136). Still further, in the integrated assembly 200, each of the multiple antenna elements 104 may be electrically connected to the feed network 116 by micro-coax via interconnects 130 (ex.—plated through vias 130).

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. An integrated antenna and feed network assembly, comprising:

an antenna, the antenna includes:

an RF substrate;

an antenna element, the antenna element being configured upon a first surface of the RF substrate; and an antenna ground plane, the antenna ground plane being configured upon a second surface of the RF substrate, the second surface being located generally opposite the first surface; and a feed network, the feed network being electrically connected to the antenna, the feed network includes:

a first RF substrate;

a second RF substrate;

a feed, the feed being connected to the first RF substrate and the second RF substrate, the feed being configured between the first RF substrate and a first surface of the second RF substrate; and a feed ground plane, the feed ground plane being configured upon a second surface of the second RF substrate, the second surface of the second RF substrate being located generally opposite the first surface of the second RF substrate, wherein the integrated antenna and feed network assembly is a printed circuit board assembly.

2. An integrated antenna and feed network assembly as claimed in claim 1, wherein the integrated antenna and feed network assembly includes a plurality of vias formed therein, said vias longitudinally extending from the antenna element, through the RF substrate of the antenna, through the antenna ground plane, through the first RF substrate of the feed network, and to the feed for electrically connecting the antenna and the feed network.

3. An integrated antenna and feed network assembly as claimed in claim 2, further comprising:

an RF connector, the RF connector being configured for connecting the integrated antenna and feed network assembly to a receiver via a coax cable.

4. An integrated antenna and feed network assembly as claimed in claim 3, further comprising:

a radome, the radome being connected to the antenna element.

5. An integrated antenna and feed network assembly as claimed in claim 4, wherein the RF substrate of the antenna, the first RF substrate of the feed network, the second RF substrate of the feed network, and the radome are formed of printed circuit board material.

6. An integrated antenna and feed network assembly as claimed in claim 1, wherein the antenna is a spiral antenna.

7. An integrated antenna and feed network assembly as claimed in claim 1, wherein the feed network includes a stripline Balun feed.

8. An integrated antenna and feed network assembly, comprising:

an antenna, the antenna including an RF substrate, the antenna further including an antenna element, the antenna element being a metal foil layer configured upon a first surface of the RF substrate, the antenna further including an antenna ground plane, the antenna ground plane being configured upon a second surface of the RF substrate, the second surface being located generally opposite the first surface; and a feed network, the feed network being electrically connected to the antenna, the feed network including a first RF substrate, the feed network further including a second RF substrate, the feed network further including a feed, the feed being connected to the first RF substrate and the second RF substrate, the feed being configured between the first RF substrate and a first surface of the second RF substrate, the feed network further including a feed ground plane, the feed ground plane being configured upon a second surface of the second RF substrate, the second surface of the second RF substrate being located generally opposite the first surface of the second RF substrate, wherein the antenna and the feed network assembly is a printed circuit board assembly.

9. An integrated antenna and feed network assembly as claimed in claim 8, wherein the integrated antenna and feed network assembly includes a plurality of vias formed therein, said vias longitudinally extending from the antenna element, through the RF substrate of the antenna, through the antenna ground plane, through the first RF substrate of the feed network, and to the feed for electrically connecting the antenna and the feed network.

10. An integrated antenna and feed network assembly as claimed in claim 9, further comprising:

an RF connector, the RF connector being configured for connecting the integrated antenna and feed network assembly to a receiver via a coax cable.

11. An integrated antenna and feed network assembly as claimed in claim 10, further comprising:

a radome, the radome being connected to the antenna element.

12. An integrated antenna and feed network assembly as claimed in claim 11, wherein the RF substrate of the antenna, the first RF substrate of the feed network, the second RF substrate of the feed network, and the radome are formed of printed circuit board material.

13. An integrated antenna and feed network assembly as claimed in claim 8, wherein the antenna is a uni-directional antenna.

14. An integrated antenna and feed network assembly as claimed in claim 8, wherein the antenna is a planar antenna and the feed network is a planar feed network.

15. An integrated antenna and feed network assembly, comprising:

a spiral antenna, the antenna including a PCB substrate, the antenna further including an antenna element, the antenna element being a copper foil layer patterned upon a first surface of the PCB substrate, the antenna further including an antenna ground plane, the antenna ground plane being configured upon a second surface of the PCB substrate, the second surface being located generally opposite the first surface;

a feed network, the feed network being electrically connected to the antenna, the feed network including a first PCB substrate, the feed network further including a second PCB substrate, the feed network further including a feed, the feed being connected to the first PCB substrate and the second PCB substrate, the feed being configured between the first PCB substrate and a first surface of the second PCB substrate, the feed network further including a feed ground plane, the feed ground plane being configured upon a second surface of the second PCB substrate, the second surface of the second PCB substrate being located generally opposite the first surface of the second PCB substrate, the integrated antenna and feed network assembly further including a plurality of vias formed therein, said vias longitudinally extending from the antenna element, through the PCB substrate of the antenna, through the antenna ground plane, through the first PCB substrate of the feed network, and to the feed for electrically connecting the antenna and the feed network;

an RF connector, the RF connector being configured for connecting the integrated antenna and feed network assembly to a receiver via a coax cable; and a radome, the radome being connected to the antenna element, wherein the integrated antenna and the feed network assembly is a printed circuit board assembly.

16. An integrated antenna and feed network assembly as claimed in claim 15, wherein the integrated antenna and feed network assembly is configured for implementation in an ELINT DF system.

17. An integrated antenna and feed network assembly as claimed in claim 15, wherein the vias are micro-coax, plated through vias.

18. An integrated antenna and feed network assembly as claimed in claim 15, wherein the feed network is a 2-18 GHz feed network.

* * * * *